US005775184A

United States Patent [19]

Cole

[11] Patent Number: 5,775,184

[45] Date of Patent: Jul. 7, 1998

[54] INDEXABLE WRENCHES

[76] Inventor: James Ellis Cole, P.O. Box 29911, Dallas, Tex. 75229-0911

[21] Appl. No.: 876,488

[22] Filed: Jun. 16, 1997

Related U.S. Application Data

[63] Continuation of Ser. No. 541,509, Oct. 10, 1995, abandoned, which is a continuation-in-part of Ser. No. 260,720, Jun. 16, 1994, Pat. No. 5,419,221.

[51] Int. Cl.[6] ..... B25B 13/46

[52] U.S. Cl. ..... 81/60; 81/58.3; 81/58.4; 81/177.8; 81/177.7

[58] Field of Search ..... 81/60–63.2, 177.8, 81/58–58.4, 177.7, 177.9; 403/84, 91, 97, 359

[56] References Cited

U.S. PATENT DOCUMENTS

| | | | |
|---|---|---|---|
| 928,375 | 7/1909 | Frick | 81/177.8 |
| 1,109,032 | 9/1914 | Bersted | 81/177.8 |
| 1,568,442 | 1/1926 | Carver | 81/177.8 |
| 1,840,685 | 1/1932 | Witherup | 81/177.7 |
| 2,921,773 | 1/1960 | Hoelzer | 81/177.8 X |
| 4,145,124 | 3/1979 | Weisgerber . | |
| 4,184,783 | 1/1980 | Hall . | |
| 4,281,601 | 8/1981 | Overman . | |
| 4,406,186 | 9/1983 | Gummow | 81/60 |
| 4,582,445 | 4/1986 | Warshawsky . | |
| 4,747,328 | 5/1988 | Howard | 81/54 |
| 4,794,829 | 1/1989 | Mosenceller | 81/177.8 |
| 4,929,113 | 5/1990 | Sheu . | |
| 5,197,817 | 3/1993 | Wood et al. . | |
| 5,581,838 | 12/1996 | Rocco . | |

FOREIGN PATENT DOCUMENTS

| | | | |
|---|---|---|---|
| 3023882 | 1/1982 | Germany | 81/177.8 |

*Primary Examiner*—D. S. Meislin

*Attorney, Agent, or Firm*—Dickstein Shapiro Morin & Oshinsky, LLP

[57] ABSTRACT

A ratchet wrench including the preferred embodiment of the invention comprises a ratchet head having a conventional ratchet system for rotating a shank about an axis, a connecting pin, and a handle. The generally cylindrical connecting pin is aligned along an axis parallel to the shank axis and is attached to the ratchet head. The connecting pin extends through an orifice in the handle, thereby connecting the handle to the ratchet head. The handle is slidable between a locked position and a unlocked position on the connecting pin. When the handle is in the locked position, splines on the forward end of the handle engage complimentary splines on the ratchet head, thereby allowing the ratchet wrench can be used to rotate a nut or bolt in a conventional manner. When the handle is in the unlocked position, the ratchet wrench can be used to rapidly rotate a nut or bolt by moving the handle in a reciprocating manner. When a nut or bolt to be rotated is near an obstruction, the handle can be unlocked, rotated about the connecting pin axis, then locked, thereby adjusting the angle between the longitudinal axis of the handle and the longitudinal axis of the ratchet head. In many instances, such angular adjustment allows the ratchet wrench to be used to rotate the nut or bolt in the conventional manner while avoiding contact between the handle and the obstruction.

5 Claims, 3 Drawing Sheets

INDEXABLE WRENCHES

This application is a continuation of application Ser. No. 08/541,509 filed Oct. 10, 1995, now abandoned, which is a continuation-in-part of Ser. No. 08/260,720 filed Jun. 16, 1994, now U.S. Pat. No. 5,419,221.

TECHNICAL FIELD

The invention relates to wrenches to which other tools, such as sockets, crowfoot-type wrenches, and the like, are connected for use in tightening and loosening nuts and bolts.

SUMMARY OF THE INVENTION

A ratchet wrench including a preferred embodiment of the invention comprises a ratchet head, a connecting pin, and a handle. The ratchet head includes a conventional ratchet system for rotating a shank about an axis. A conventional socket or an open-end or closed-end crowfoot-type wrench can be connected to the shank.

The generally cylindrical connecting pin is aligned along an axis parallel to the shank axis and attached to the ratchet head. The connecting pin extends through a splined orifice in the handle, thereby connecting the handle to the ratchet head. A portion of the connecting pin includes splines adapted to engage the orifice splines in a complementary manner to prevent rotation of the handle about the connecting pin axis; and an indented portion of the connecting pin is adapted to allow the handle to rotate freely about the connecting pin axis.

The handle is slidable between a locked position and a unlocked position on the connecting pin. In the locked position, the handle orifice is disposed about the splined portion of the connecting pin, the orifice splines engage the connecting pin splines, and the ratchet wrench can be used to rotate a nut or bolt in a conventional manner. In the unlocked position, the handle orifice is disposed about the indented portion of the connecting pin and the ratchet head can rotate in a full circle about the connecting pin axis. This allows the ratchet wrench to be used to rapidly rotate a nut or bolt by moving the handle in a reciprocating manner.

When a nut or bolt to be rotated by the ratchet wrench is near an obstruction, the handle can be unlocked, rotated about the connecting pin axis, then locked, thereby adjusting the angle between the longitudinal axis of the handle and the longitudinal axis of the ratchet head. In many instances, such angular adjustment allows the ratchet wrench to be used to rotate the nut or bolt in the conventional manner while avoiding contact between the handle and the obstruction.

The construction of a ratchet wrench including a second embodiment of the invention is quite similar to that of the ratchet wrench of the preferred embodiment. However, in the second embodiment, the handle orifice is smooth; that is, it lacks the splines of the preferred embodiment. Also, the portions of the connecting pin on which the handle orifice is disposed in the locked and unlocked positions are smooth. Splines are provided on a generally circular surface at the end of the handle. When the handle is in the locked position, the handle splines engage complimentary splines on a rear surface of the ratchet head, and the ratchet wrench can be used in a conventional manner. When the handle is in the unlocked position, it is free to rotate about the connecting pin and, thus, the ratchet head. As with the ratchet wrench of the preferred embodiment, the handle of the ratchet wrench can be adjusted relative to the longitudinal axis of the ratchet head to allow the ratchet wrench to be used to tighten or loosen a nut or bolt near an obstruction while avoiding contact between the wrench and the obstruction.

A breaker bar including a third embodiment of the invention comprises a handle and a connecting pin. As with the preferred embodiment of the invention, the handle of the breaker bar includes a splined orifice at one end. The connecting pin includes a smooth portion, a splined portion, and a conventional shank. When the handle orifice is positioned about the smooth portion of the connecting pin (the "unlocked position"), the handle is free to rotate about the connecting pin. When the handle orifice is positioned about the splined portion of the connecting pin (the "locked position"), the handle orifice splines and connecting pin splines engage, thereby preventing rotation of the connecting pin. When a crowfoot-type wrench is connected to the shank, the handle can be moved to the unlocked position to allow the angular relationship between the crowfoot-type wrench and the handle to be adjusted.

BRIEF DESCRIPTION OF THE DRAWINGS

Three wrenches embodying the invention will be described, by way of example only, with reference to the accompanying drawings, in which.

DETAILED DESCRIPTION OF THE INVENTION

Figure 1:
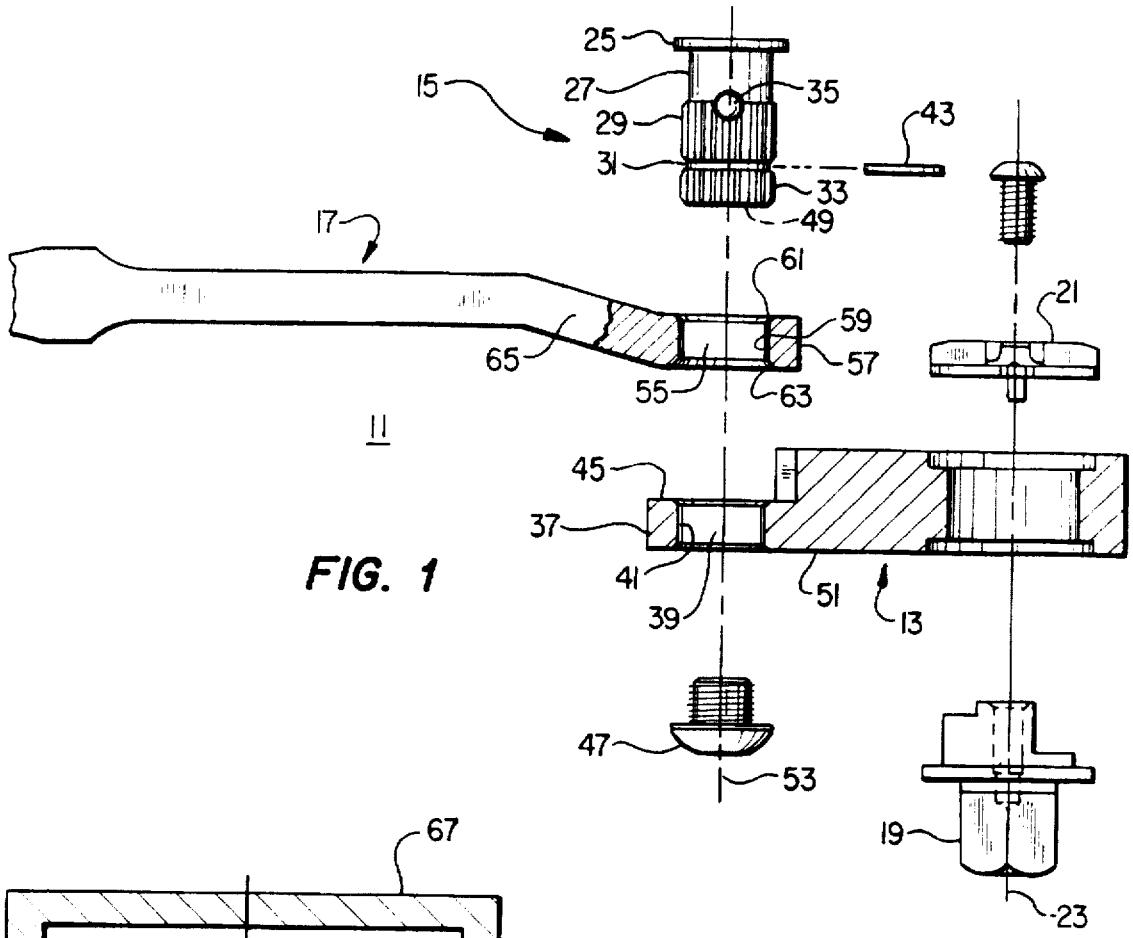
FIG. 1 is a partial, exploded side view of a ratchet wrench including the preferred embodiment of the invention.
Figure 2:
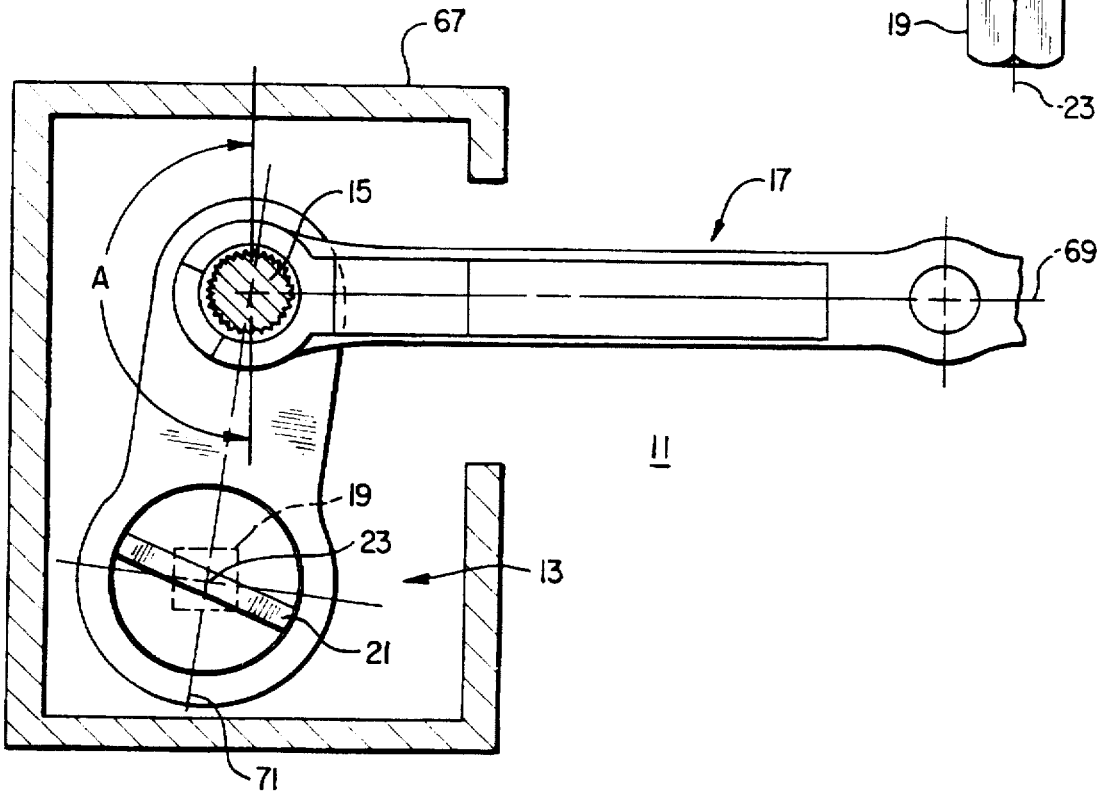
FIG. 2 is a partial top view of the ratchet wrench of FIG. 1 with the connecting pin cap cut away.

FIGS. 1 and 2 illustrate a ratchet wrench 11 which includes a preferred embodiment of the invention. The ratchet wrench 11 comprises a ratchet head 13, a connecting pin 15, and a handle 17. The ratchet head 13 is provided with a conventional ratchet system which includes a shank 19 and a ratchet direction selector 21. The ratchet direction selector 21 can be positioned to cause the shank 19 to drive a connected socket (not shown) clockwise or counterclockwise about the shank axis 23.

From top to bottom in FIG. 1, the generally cylindrical connecting pin 15 comprises a radially extending cap 25, an indentation 27, upper splines 29, an annular groove 31, and lower splines 33. A spring-loaded detent ball 35 is provided in the connecting pin 15 at the juncture of the indentation 27 and the upper splines 29.

An integral arm 37 extending from the ratchet head 13 is provided with an orifice 39 having splines 41 adapted to engage the lower connecting pin splines 33 in a complementary manner. In the assembled ratchet wrench 11, the lower connecting pin splines 33 engage the arm orifice splines 41, a retaining ring 43 installed in the connecting pin groove 31 abuts an upper surface 45 of the arm 37, and a screw 47 engaged in a threaded orifice 49 in the connecting pin 15 abuts a lower surface 51 of the arm 37. As a result, the connecting pin 15 is attached to the arm 37 and aligned along an axis 53 that is parallel to the shank axis 23. Those skilled in the art will appreciate that the connecting pin 15 can be attached to the arm by other means, such as by press-fitting or adhesively bonding the arm orifice splines 41 and the connecting pin lower splines 33, thereby eliminating the need for the groove 31, retaining ring 43, screw 47, and connecting pin orifice 49.

An orifice 55 in an end 57 of the handle 17 adjacent to the ratchet head arm 37 is provided with splines 59, an upper chamfer 61, and a lower chamfer 63. In the assembled ratchet wrench 11, the handle orifice 55 is installed on the connecting pin 15 and is axially slidable thereon between an uppermost position and a lowermost position on the connecting pin 15. The connecting pin cap 25 and the ratchet head arm 37 cooperate to retain the handle end 57 on the connecting pin 15.

The detent ball 35 acts to retain the handle 17 in the uppermost and lowermost positions on the connecting pin 15. The upper and lower chamfers 61, 63, in combination with an appropriate spring load on the detent ball 35, allow the handle 17 to be moved easily between the uppermost and lowermost positions on the connecting pin 15.

When the handle 17 is in the uppermost position on the connecting pin 15, the handle orifice 55 is disposed about the connecting pin indentation 27. The diameter of the indentation 27 is slightly less than the inside diameter handle orifice splines 59. Hence, the handle 15 is free to rotate about the connecting pin 15 ("unlocked"). A stepup 65 in the handle 17 provides vertical clearance between the handle 17 and the ratchet direction selector 21, allowing the ratchet head 13 to rotate in a complete circle about the connecting pin 15. When the handle 17 is moved in a reciprocating manner, the ratchet shank 19 and attached socket (not shown) rotate about the ratchet shank axis 23. As a result, the handle 17 can be moved in a reciprocating manner to rapidly spin a nut or bolt (not shown) on or off of a mating member (not shown). If an obstruction 67 prevents movement of the ratchet head 13 in a full circle, a combination of reciprocating handle motion and the action of the ratchet system will rotate a nut or bolt somewhat less rapidly, but more rapidly than with conventional ratchet action.

When the handle 17 is in the lowermost position on the connecting pin 15, the handle orifice 55 is disposed about the upper connecting pin splines 29 and the handle orifice splines 59 engage the upper connecting pin splines 29, thereby preventing rotation of the handle 17 about the connecting pin 15. This allows the wrench 11 to be used in the conventional manner to drive the shank 19.

The angle between the longitudinal axis 69 of the handle 17 and the longitudinal axis 71 of the ratchet head 13 can be adjusted through an angle A of 180 degrees by unlocking the handle 17, rotating it about the connecting pin 15 to the desired position, then relocking it. This allows the ratchet wrench 11 to be used in instances in which an obstruction 67 prevents use of a conventional ratchet wrench. In this embodiment of the invention, there are 24 upper connecting pin splines 31, allowing the handle 17 to be locked in 13 different angular positions.

While the upper connecting pin splines 29 and the complementary handle orifice splines 59 provide the angular adjustment means in the preferred embodiment, it is to be understood that this aspect of the invention is not limited to members having splined cross sections. For example, virtually any regular polygonal cross-section could be used to perform the angular adjustment function.

Figure 3:
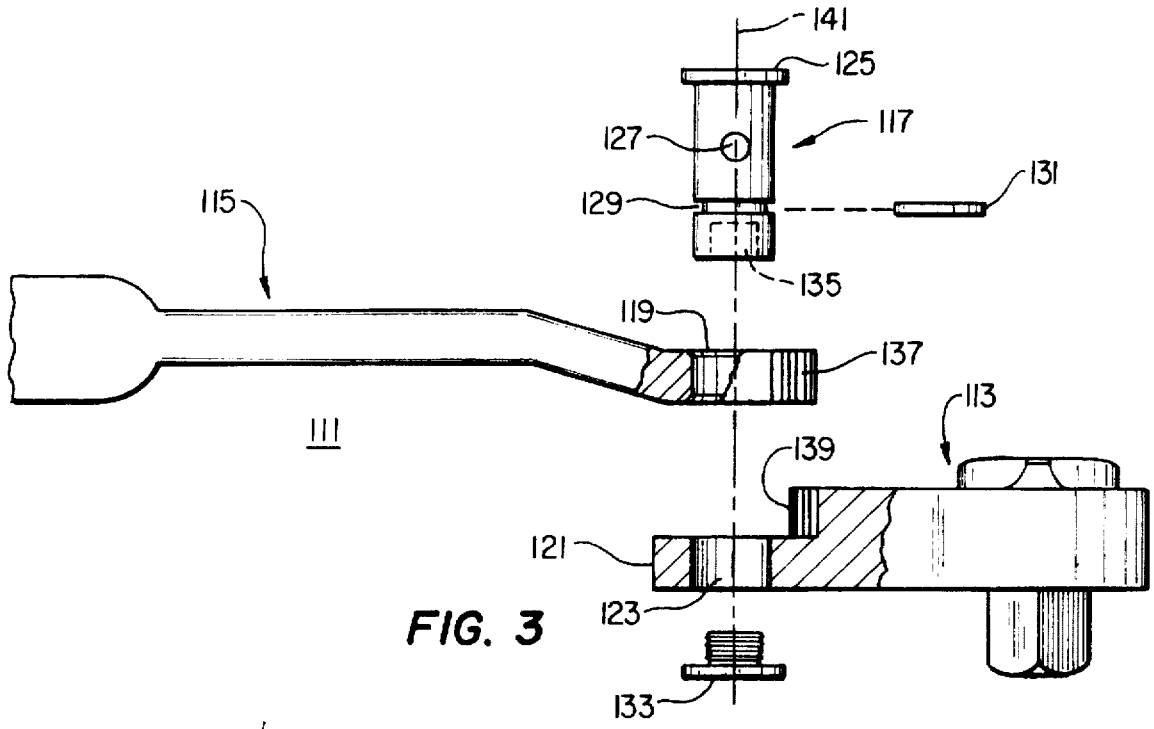
FIG. 3 is a partial, exploded side view of a ratchet wrench including a second embodiment of the invention.
Figure 4:
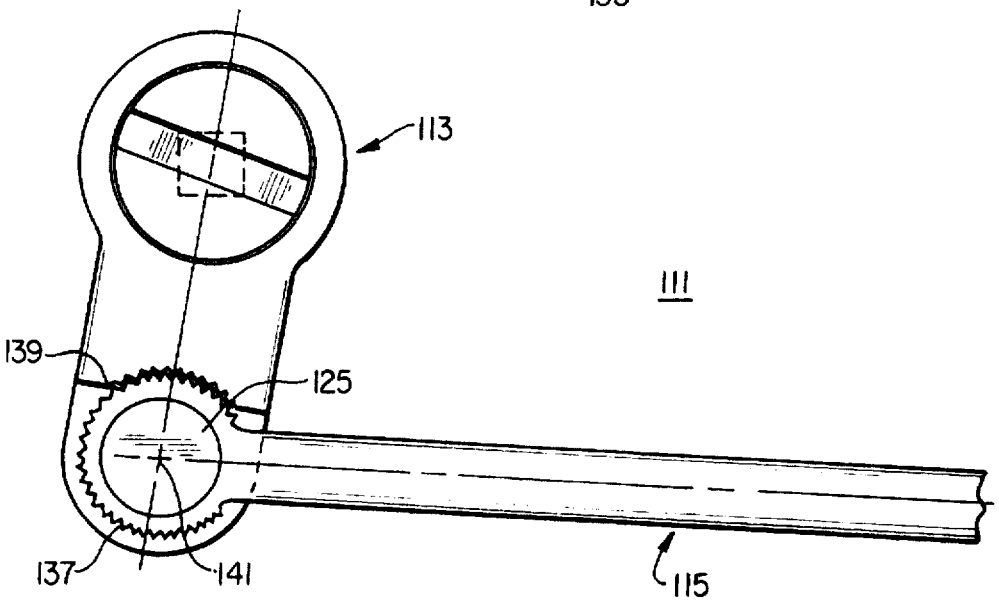
FIG. 4 is a partial top view of the ratchet wrench of FIG. 3.

FIGS. 3 and 4 illustrate a ratchet wrench 111 which includes second embodiment of the invention. As with the preferred embodiment of FIGS. 1 and 2, a ratchet wrench 111 comprises a ratchet head 113 connected to a handle 115 by a connecting pin 117. Similarly, an orifice 119 is provided in the end of the handle 115 adjacent to the ratchet head 113, and an integral arm 121 extending from the ratchet head 113 is provided with an orifice 123. In this embodiment of the invention, the handle and ratchet head orifices 119, 123 are smooth, unlike the splined orifices 39, 55 of the preferred embodiment shown in FIGS. 1 and 2.

From top to bottom in FIG. 3, the cylindrical connecting pin 117 includes a radially-extending cap 125, a spring-loaded ball 127, and an annular groove 129. Except for the cap 125 and the groove 129, the diameter of the connecting pin 117 is constant along its length.

The handle orifice 119 is sized to provide a sliding fit with the connecting pin 117, and the ratchet head orifice 123 is sized to provide a press fit with the connecting pin 117. When the ratchet wrench 111 is assembled, the handle orifice 119 is positioned on the connecting pin 117 above the connecting pin groove 129, and a retaining ring 131 is installed in the groove 129. The connecting pin 117 is then press-fitted into the ratchet head orifice 123 until the retaining ring 131 abuts the upper surface of the ratchet head arm 121. Finally, a screw 133 installed in a threaded orifice 135 in the lower end of the connecting pin 117 abuts the lower surface of the ratchet head arm 121.

When the handle 115 is in the lowermost position on the connecting pin 117 (below the spring-loaded ball 127), splines 137 on the end of the handle 115 engage complimentary splines 139 on a rear surface the ratchet head 113, thereby preventing rotation of the handle 115 about the connecting pin 117. As best seen in FIG. 4, the end of the handle 115 is generally circular, and the handle splines 137 extend approximately 280 degrees. The surface of the ratchet head 113 which contains the ratchet head splines 139 is arcuate and mates with approximately 90 degrees of the handle splines 137. When the handle 115 is in the uppermost position on the connecting pin 117 (above the spring-loaded ball 127), the handle 115 is free to rotate about the axis 141 of the connecting pin 117. Hence, when the handle 115 is in the uppermost position, it is "unlocked" from the ratchet head 113, and when the handle 113 is in the lowermost position it is "locked" to the ratchet head 113. Thus, as with the preferred embodiment, the handle 115 of this embodiment can be adjusted through an angle of approximately 200 degrees relative to the longitudinal axis 141 of the ratchet head 113.

Figure 5:
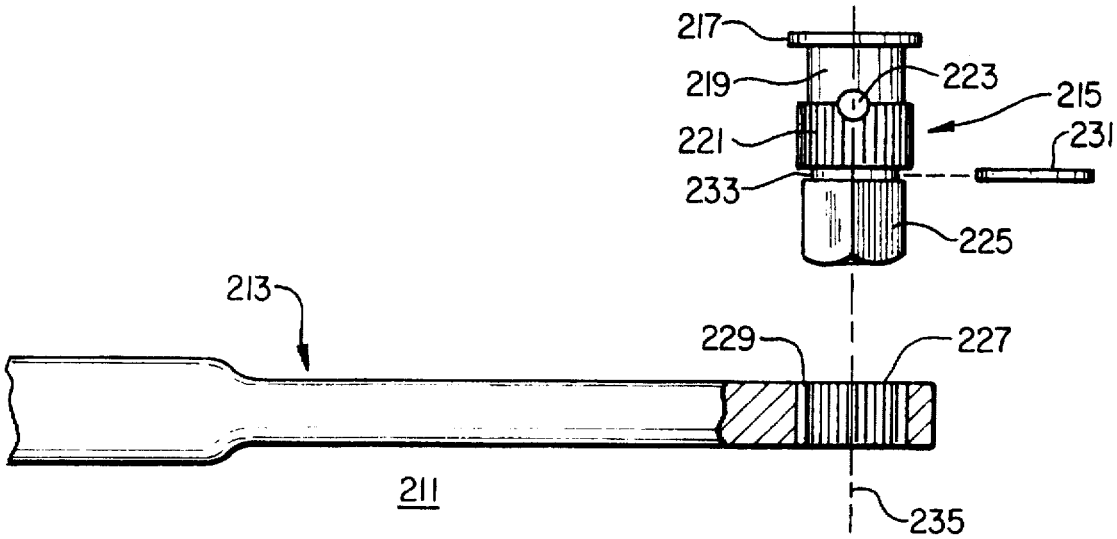
FIG. 5 is a partial, exploded side view of a breaker bar including a third embodiment of the invention.
Figure 6:
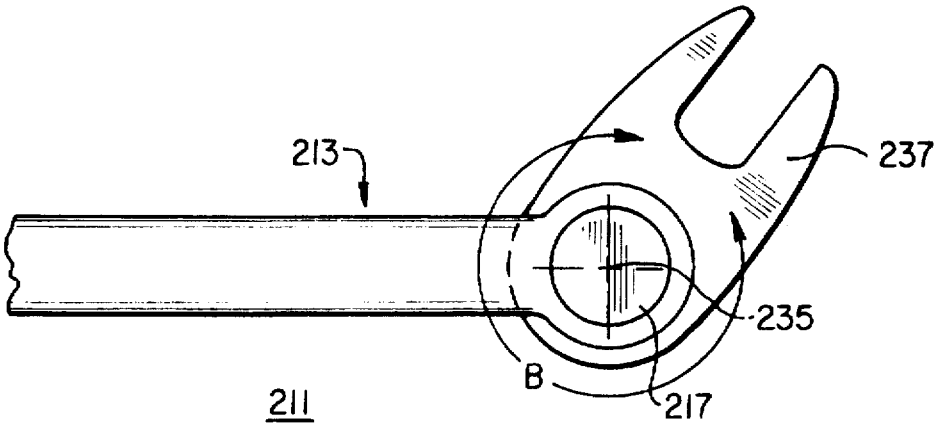
FIG. 6 is a top view of the breaker bar of FIG. 5.

FIGS. 5 and 6 illustrate a breaker bar 211 which includes a third embodiment of the invention. The breaker bar 211 comprises a handle 213 and a connecting pin 215. The connecting pin 215 includes a radially-extending cap 217, a smooth upper portion 219, a splined portion 221, and a spring-loaded ball 223, and a conventional shank 225. An orifice 227 having splines 229 which compliment the connecting pin splines 221 is provided in the end of the handle 213. The connecting pin splines 221 and the handle splines 229 are sized to allow the connecting pin 215 to slide axially through the handle orifice 227. When the wrench 211 is assembled, the connecting pin 215 passes through the handle orifice 227 and a retaining ring 231 engages a groove 233 between the shank 225 and the connecting pin splines 221. The retaining ring 231 prevents the connecting pin 215 from being pushed upwardly out of the handle orifice 227.

As with the ratchet wrench 11 shown in FIGS. 1 and 2, when the handle orifice 227 is in the uppermost position on the connecting pin 215, the handle 213 is free to rotate about the connection pin 215. When the handle 213 is in positioned over the connecting pin splines 221, the handle 213 and the connecting pin 215 are locked in position relative to the axis 235 of the connecting pin. As shown in FIG. 6, this allows angular adjustment between a conventional crowfoot-type wrench 237 and the handle 213 through an angle B of 360 degrees.

While three wrenches embodying the invention have been shown and described, it will be apparent to those skilled in this art that various modifications may be made to the wrenches without departing from the spirit of the present invention.

I claim:

1. A tool comprising:

a tool head including a first orifice having a first longitudinal axis and a first curved surface at a predetermined radial distance from the first longitudinal axis, the first curved surface including a first plurality of splines disposed parallel to the first longitudinal axis;

a handle including a second orifice having a second longitudinal axis, the first and second longitudinal axes being coaxial, and a second curved surface, the second curved surface being disposed of a predetermined radial distance from the second longitudinal axis and including a second plurality of splines configured to engage the first plurality of splines;

a connecting pin disposed in the first and second orifices and connecting the tool head and the handle;

the connecting pin being rigidly attached to a first one of the tool head and the handle, a second one of the tool head and the handle being slidable between a locked position and an unlocked position on the connecting pin;

in the unlocked position, the second one being free to rotate completely about the connecting pin; and in the locked position, the first plurality of splines engaging the second plurality of splines to rotationally lock the handle to the tool head.

2. The ratchet wrench of claim 1 wherein the connecting pin is attached to the first orifice and the handle is slidable along the connecting pin between the locked position and the unlocked position.

3. The ratchet of claim 2 wherein the locked position includes a plurality of locked positions, the handle being rotatable through an arc of about 200 degrees to engage the first plurality of splines with the second plurality of splines in the plurality of locked positions.

4. An adjustable tool comprising:

a tool head having a first orifice;

a handle having a second orifice, the first and second orifices being coaxially aligned;

a connecting pin disposed in the first and second orifices and coupling the tool head to the handle, the connecting pin including first, second and third portions, the first portion being rigidly coupled to one of the tool head and the handle, the second portion being splined, and the third portion being smooth, the orifice of the other of the tool head and handle being splined to engage the splined second portion of the connecting pin to define a locked position and rotatable about the smooth third portion of the connecting pin to define an unlocked position, the other of the tool head and the handle being movable axially along the connecting pin between the second and third portions to move between the locked position and the unlocked position.

5. The adjustable tool of claim 4 wherein the first portion of the connecting pin is rigidly coupled to the tool head and the handle is movable between the locked position and the unlocked position along the connecting pin.

* * * * *